United States Patent [19]

Ishikawa et al.

[11] 4,455,360

[45] Jun. 19, 1984

[54] ELECTROPHOTOGRAPHIC TONER COMPRISING CINNAMIC ACID

[75] Inventors: Koji Ishikawa, Chiba; Hiroshi Ozawa, Kanagawa; Nobuki Kobayashi, Yokohama; Yoshio Kikuta, Zushi; Kenichi Nakane, Hayama, all of Japan

[73] Assignee: Mitsui Toatsu Chemicals, Incorporated, Tokyo, Japan

[21] Appl. No.: 154,910

[22] Filed: May 30, 1980

[30] Foreign Application Priority Data

Jun. 13, 1979 [JP] Japan ..... 54-73489
Feb. 8, 1980 [JP] Japan ..... 55-13573

[51] Int. Cl.[3] ..... G03G 9/08
[52] U.S. Cl. ..... 430/109; 430/904
[58] Field of Search ..... 430/109, 108, 904

[56] References Cited

U.S. PATENT DOCUMENTS

| | | | |
|---|---|---|---|
| 3,236,639 | 2/1966 | Tomanek | 430/107 |
| 3,236,776 | 2/1966 | Tomanek et al. | 430/109 |
| 3,510,338 | 5/1970 | Varrow | 430/109 X |
| 3,740,334 | 6/1973 | Jacknow | 430/109 X |
| 3,753,909 | 8/1973 | Hulme | 430/109 |
| 3,900,412 | 8/1975 | Kosel | 430/115 |
| 4,134,847 | 1/1979 | Oda et al. | 430/107 |
| 4,247,597 | 1/1981 | Russell | 428/403 |

*Primary Examiner*—John D. Welsh
*Attorney, Agent, or Firm*—Fisher, Christen & Sabol

[57] ABSTRACT

An electrophotographic toner comprising a constituent resin and a colorant, in which the constituent resin has a softening point ranging from room temperature to 170° C. and comprises (a) a copolymer of cinnamic acid and one or more vinyl monomers, (b) a mixture of a copolymer as defined in (a) and a polymer having good compatibility therewith, (c) a mixture of a copolymer as defined in (a) and cinnamic acid, (d) a mixture of a polymer as defined in (b) and cinnamic acid, or (e) a mixture of a mixture as defined in (b) and cinnamic acid, the cinnamic acid content of the constituent resin being from 1 to 25 parts by weight per 100 parts by weight of the constituent resin in the case of cinnamic acid copolymerized with one or more vinyl monomers and from 0.1 to 25 parts by weight per 100 parts by weight of the constituent resin in the case of cinnamic acid present in the uncombined state.

20 Claims, No Drawings

ELECTROPHOTOGRAPHIC TONER COMPRISING CINNAMIC ACID

BACKGROUND OF THE INVENTION

1. Field of the Invention

This invention relates to improvements in electrophotographic toners and, more particularly, to an electrophotographic toner whose practical performance is improved by introducing cinnamic acid into its constituent resin.

2. Description of the Prior Art

Conventionally, there are a number of methods for rendering visible an electrostatic latent image formed by electrophotographic or electrostatographic techniques. In commercial applications are widely used the cascade process in which a mixture of electrically insulating toner particles and larger carrier particles (typically, glass beads) is rolled or cascaded across the image-bearing surface and the magnetic brush process in which magnetic carrier particles (typically, powdered iron) are manipulated by magnetic force. These processes are both characterized in that the toner particles are triboelectrically charged by contact with the carrier particles and then deposited on the charged portions of the latent image by electrostatic attraction.

It is well-known that the developing toners used in these processes usually comprise a natural or synthetic thermoplastic resin having added thereto a pigment (for example, carbon black) and a dyestuff as a charge sign controlling agent. It is also well-known that the natural or synthetic thermoplastic resins useful as the principal constituent of prior art developing toners include polystyrene, polyester resin, polymethacrylate resin, polyvinyl chloride, xylene resin, polyamide resin, rosin, ester gum, shellac, etc.

However, when toners comprising any of the foregoing resins are triboelectrically charged, in the absence of a charge sign controlling agent, especially by the cascade or magnetic brush process, the magnitude of positive or negative charge so produced is not sufficient to provide a highly dense and distinct image. As is well-known, such a toner can be strongly charged by the addition of a charge sign controlling agent. By way of example, an oil-soluble azo dye containing a complex compound of chromium is added in order to allow the toner to produce a strong negative charge and a basic dye is added in order to allow the toner to produce a strong positive charge. Nevertheless, since it is generally difficult to disperse such a dyestuff evenly throughout a thermoplastic resin, uniform negative or positive charges are hardly produced on the resulting toner particles. Accordingly, toners containing such a dyestuff tend to have many disadvantages including poor adhesion to copying paper, fogging of the developed image (that is, the deposition of the toner on the uncharged or background portions of the latent image during development), low long-term stability (that is, change in triboelectric charging properties of the toner during its long-term, repeated use in a copying machine), and nonuniform image density.

SUMMARY OF THE INVENTION

It is an object of the present invention to provide an electrophotographic toner having an improved constituent resin.

It is another object of the present invention to provide an improved electrophotographic toner which shows little variation in the magnitude of triboelectric charges produced on toner particles, no fogging of the developed image, and good fixing properties.

It is still another object of the present invention to provide an improved electrophotographic toner which can be used stably for a long period of time.

The present inventors have investigated the interrelationship between the physical and chemical properties of toner constituents and the suitability of the toner for electrophotographic purposes and have found that the disadvantages (for example, fogging and poor fixing properties) of prior art toners containing a dyestuff as a charge sign controlling agent can be eliminated by introducing cinnamic acid, which has not yet been used as a toner constituent, in the form of a copolymer with one or more vinyl monomers and/or in the uncombined state.

The present invention provides, in a toner composition for use in the development of electrostatic latent images comprising a constituent resin and a colorant, the improvement in which the constituent resin has a softening point ranging from room temperature to 170° C. and comprises a member selected from the group consisting of (a) a copolymer of cinnamic acid and one or more vinyl monomers, (a) a mixture of a copolymer as defined in (a) and a polymer having good compatibility therewith, (c) a mixture of a copolymer as defined in (a) and cinnamic acid, (d) a mixture of a polymer as defined in (b) and cinnamic acid, and (e) a mixture of a mixture as defined in (b) and cinnamic acid, the cinnamic acid content of the constituent resin being from 1 to 25 parts by weight per 100 parts by weight of the constituent resin in the case of cinnamic acid copolymerized with one or more vinyl monomers and from 0.1 to 25 parts by weight per 100 parts by weight of the constituent resin in the case of cinnamic acid present in the uncombined state.

The expression "cinnamic acid copolymerized with one or more vinyl monomers" as used herein denotes any form of cinnamic acid present in a copolymer of cinnamic acid and one or more vinyl monomers.

DETAILED DESCRIPTION OF THE PREFERRED EMBODIMENTS

The vinyl monomers which are copolymerizable with cinnamic acid and useful in the preparation of a copolymer of cinnamic acid and one or more vinyl monomers to be used in the toner composition of the present invention include, for example, styrene; styrene derivatives such as α-methylstyrene, p-chlorostyrene, vinyltoluene, etc,; acrylic esters such as methyl acrylate, ethyl acrylate, isobutyl acrylate, n-butyl acrylate, 2-ethylhexyl acrylate, dodecyl acrylate, cyclohexyl acrylate, 2-chloroethyl acrylate, 2-hydroxyethyl acrylate, dimethylaminoethyl acrylate, methyl α-chloroacrylate, etc,; methacrylic esters such as methyl methacrylate, ethyl methacrylate, propyl metacrylate, isobutyl methacrylate, n-butyl methacrylate, 2-ethylhexyl methacrylate, lauryl methacrylate,. stearyl methacrylate, phenyl methacrylate, cyclohexyl methacrylate, tridecyl methacrylate, 2-hydroxyethyl methacrylate, 2-hydroxypropyl methacrylate, dimethylaminoethyl methacrylate, diethylaminoethyl methacrylate, etc,; organic amides such as acrylamide, methacrylamide, dimethylacrylamide, N-butoxyacrylamide, diacetone acrylamide, etc,; ethylenic monoolefins such as ethylene, propylene, butylene, isobutylene, etc,; vinyl esters such as vinyl acetate, vinyl propionate, vinyl butyrate, etc,; ethylenically unsaturated carboxylic acids such as acrylic acid, methacrylic acid, crotonic acid, itaconic acid, maleic acid, fumaric acid, etc; itaconic esters such as diethyl itaconate, dibutyl itaconate, etc.; fumaric esters such as diethyl fumarate, dibutyl fumarate, etc,; and the like. These vinyl monomers may be used alone or in combination.

Among the copolymers prepared from cinnamic acid and the foregoing vinyl monomers, cinnamic acid/-styrene/2-ethylhexyl acrylate copolymers, cinnamic acid/styrene/n-butyl methacrylate copolymers, and cinnamic acid/styrene/methyl methacrylate/n-butyl acrylate copolymers are particularly preferred.

The copolymer used in the toner composition of the present invention can be prepared by any of well-known polymerization techniques including solution polymerization, suspension polymerization, emulsion polymerization, bulk polymerization, and suitable combinations thereof.

The polymer used in admixture was the above-described copolymer of cinnamic acid and one or more vinyl monomers can be any well-known resin that has good compatibility with the copolymer. Typical examples thereof include styrene resin, acrylic resin, styrene-acrylate copolymer resin, styrene-butadiene copolymer resin, epoxy resin, polyurethane resin, polyether resin, coumarone resin, maleinized rosin, rosin-modified phenol-formaldehyde resin, cellulose resin, polyamide resin, silicone resin, polyvinyl butyral resin, phenolic resin, and mixtures thereof. Among these resins, styrene resin, acrylic resin, styrene-acrylate copolymer resin, styrene-butadiene copolymer resin, epoxy resin, and maleinized rosin are particularly preferred.

In the toner composition of the present invention, the cinnamic acid content of the constituent resin should be from 1 to 25 parts by weight, preferably from 1 to 15 parts by weight, per 100 parts by weight of the constituent resin in the case of cinnamic acid copolymerized with one or more vinyl monomers and from 0.1 to 25 parts by weight, preferably from 1 to 15 parts by weight, per 100 parts by weight of the constituent resin in the case of cinnamic acid present in the uncombined state. However, the sum of the content of cinnamic acid copolymerized with one or more vinyl monomers and the content of cinnamic acid present in the uncombined state cannot exceed 25 parts by weight per 100 parts by weight of the constituent resin. If the content of cinnamic acid copolymerized with one or more vinyl monomers is less than 1 part by weight and the content of cinnamic acid present in the uncombined state is less than 0.1 part by weight, no beneficial effect is produced. On the other hand, if the content of cinnamic acid copolymerized with one or more vinyl monomers or present in the uncombined state is greater than 25 parts by weight, the resulting toner is so hygroscopic that it shows changes in triboelectric charging properties and-/or the formation of agglomerates and, consequently, its long-term stability is reduced.

In the toner composition of the present invention, the constituent resin should have a softening point ranging from room temperature to 170° C., the preferred range being from 50° to 150° C. So long as the constituent resin satisfies this requirement, the resulting toner shows no stickiness or agglomeration when allowed to stand at room temperature and possesses good fixing properties during development. If the softening point is higher than 170° C., the development process requires such high fixing temperatures that it is necessary to use copying paper having high heat resistance and/or difficult problems tend to arise, for example, as to the design of a fixing device producing high temperatures. Moreover, the constituent resin is so hard that, in the step of grinding it to a particulate size of 5–20$\mu$, an excessive size reduction tends to occur and results in fogging of the developed image.

If desired, the above-described constituent resin may further contain one or more additives selected from low-molecular-weight polyalkylene compounds, paraffin wax, fatty acid metal salts, fatty acid amides, liquid acrylic resin; plasticizers; pigment dispersing agents; and the like.

The toner composition of the present invention can be prepared, for example, by mixing a constituent resin as described above with a suitable colorant selected from pigments (including carbon black), dyestuffs, and combinations thereof and then subjecting this mixture to a conventional grinding or spray drying process. In the case of a typical grinding process, a mixture of a constituent resin and a colorant is preblended in a vibration mill and then transferred to a roll mill, where the mixture is melted and milled. The resulting blend is crushed in a hammer mill and then pulverized in a jet mill to obtain a toner powder having a particle size of 5–20$\mu$. In the case of a typical spray drying process, a mixture of a constituent and a colorant is dissolved in a suitable solvent. The resulting solution is sprayed to form an atomized mist, which is dried and collected with an electrical dust precipitator to obtain a toner powder.

Alternatively, the toner composition of the present invention can be prepared by premixing a specified amount of cinnamic acid with a copolymer of cinnamic acid and one or more vinyl monomers and/or a polymer having good compatibility therewith and, whenever need arises, incorporating a colorant (for example, carbon black) into the premix.

The constituent resin included in the toner composition of the present invention is useful not only in the preparation of a toner composition for use in dry developers but also in the preparation of a toner composition for use in liquid developers comprising toner particles dispersed in an electrically insulating liquid.

The toner composition of the present invention is free from such disadvantages as nonuniform image density, fogging, poor fixing properties, fly loss, and agglomeration. Moreover, it has a remarkably prolonged service life due to its good stability. Especially when used in a copying machine of the type in which a series of charging, exposure, development, transfer, fixing, and discharge steps is repeated, it is of great practical value because copies of good quality can be obtained throughout a great number of electrophotographic runs.

The present invention will be more fully understood by reference to the following examples. However, these examples are intended merely to illustrate the practice of the invention and are not to be construed to limit the scope of the invention.

EXAMPLES 1 TO 8

(1) Preparation of Copolymers of Cinnamic Acid and Vinyl Monomers

Into a four neck flask fitted with a stirrer, a reflux condenser, a therometer, and a nitrogen inlet tube were charged various monomers, a polymerization initiator, a chain transfer agent, a dispersing agent, and deionized water. The type and amount of these starting materials and chemical agents are indicated in Table 1. After the air in the flask was replaced by nitrogen, the reaction mixture was heated to 90° C., with stirring, and held at that temperature for 6 hours to complete the polymerization reaction. Upon cooling, the polymerization product in the form of pearls was separated by filtration and then dried to obtain a copolymer of cinnamic acid and vinyl monomers falling within the scope of the present invention. The six copolymers thus obtained are referred to as copolymers A to F. Then, their softening points were measured by the ring and ball method of ASTM E-28. The results thus obtained are summarized in Table 1.

TABLE 1

| | | | Designation of Copolymer | | | | | |
|---|---|---|---|---|---|---|---|---|
| | | | A | B | C | D | E | F |
| Amount of Starting Materials and Chemical Agents Used (parts by weight) | Monomers | Cinnamic acid | 5 | 8 | 16 | 24 | 8 | 12 |
| | | Styrene | 61 | 40 | 53 | 52 | 30 | 55 |
| | | α-Methylstyrene | — | — | 5 | — | — | — |
| | | 2-Ethylhexyl acrylate | 23 | — | 15 | 14 | 15 | 10 |
| | | 2-Hydroxyethyl acrylate | — | — | — | — | 3 | — |
| | | Methyl methacrylate | — | 23 | — | 10 | 30 | — |
| | | n-Butyl methacrylate | 11 | 10 | — | — | — | 18 |
| | | Diethylaminoethyl methacrylate | — | — | 5 | — | — | — |
| | | Acrylamide | — | — | 6 | — | — | — |
| | | Methacrylic acid | — | — | — | — | — | 5 |
| | | Vinyl acetate | — | 9 | — | — | — | — |
| | | Dibutyl fumarate | — | 10 | — | — | 14 | — |
| | Polymerization initiator (azobisisobutyronitrile) | | 2 | 2 | 2 | 2 | 2 | 2 |
| | Chain transfer agent (tert-dodecyl mercaptan) | | 0.2 | 0.3 | 0.1 | 0.1 | 0.2 | 0.3 |
| | Dispersing agent (partial saponification product of polyvinyl alcohol*) | | 1 | 1 | 1 | 1 | 1 | 1 |
| | Deionized water | | 200 | 200 | 200 | 200 | 200 | 200 |
| Softening Point of Copolymer | | | 125 | 130 | 125 | 115 | 120 | 130 |

*Commercially available under the trade name of Gosenol GH-23 from Nippon Gosei Kagaku K. K., Japan.

(2) Preparation of Toners

A total of eight constituent resins were provided by using the above-described copolymers of cinnamic acid and vinyl monomers alone (Examples 1–6) or in combination with polystyrene having a softening point of 125° C. (Picolastic D-125, manufactured and sold by Esso Standard Corp.) or maleinized resin having a softening point of 110° C. (Examples 7 and 8). Each of these constituent resins and carbon black were mixed in the proportion indicated in Table 2, ground to a particle size of 100–500μ in a vibration mill, and then intimately blended by heating to melt the mixture and milling the melt in a roll mill. After cooling, the resulting blend was crushed to a particle size on the order of 1 mm in a hammer mill, finely ground in a pulverizer of the air jet type, and then subjected to air classification. Thus, a total of eight toners having an average particle size of approximately 5–20μ were obtained (Examples 1–8).

(3) Evaluation of Toners

Each of the toners prepared in Examples 1–8 was mixed with powdered iron (having a particle size of the order of 250–400 mesh) as a carrier so that the toner content was 10–15%. Then, using an electrophotographic copying machine (Model NP-1200, manufactured and sold by Canon Co., Ltd., Japan), the resulting developers were subjected to the evaluation tests described below. The results thus obtained are summarized in Table 2. (Evaluation Tests and Testing Procedures)

(1) Triboelectric charging properties: The triboelectric charging properties of a toner were evaluated by measuring the magnitude of electric charge with an apparatus comprising a Farady cube combined with a potentiometer (cf. "Introduction to Electrostatics", §3.2.4).

(2) Transfer properties: The transfer properties of a toner were evaluated by measuring the weight ratio of the transferred powder image to the powder image formed on a photoresponsive plate.

(3) Fixing properties: The fixing properties of a toner were evaluated on the basis of the fusion rate of the toner heated by a heating roller and the adhesion of the toner to the surface of the heating roller.

(4) Image quality: The quality of the developed image was synthetically evaluated on the basis of such factors as definition, fogging, etc.

(5) Service life: The service life of a toner was expressed in terms of the maximum number of electrophotographic runs in which the toner was repeatedly used to give clear copies.

(6) Storage stability: The storage stability of a toner was evaluated by storing the toner at room temperature for one year and then examining it from the viewpoints of stickiness, agglomeration, moisture absorption, change in properties with time, etc.

TABLE 2

| | Formulation | | Toner Performance | | | | | |
|---|---|---|---|---|---|---|---|---|
| Example | Constituent Resin (parts by weight) | Carbon Black (parts by weight) | Triboelectric Charging Properties | Transfer Properties | Fixing Properties | Image Quality | Service Life (number of runs) | Storage Stability |
| 1 | Copolymer A 90 | 10 | Good | Good | Good | Good | More than 20,000 | Good |

TABLE 2-continued

| | Formulation | | Toner Performance | | | | | |
|---|---|---|---|---|---|---|---|---|
| Example | Constituent Resin (parts by weight) | Carbon Black (parts by weight) | Triboelectric Charging Properties | Transfer Properties | Fixing Properties | Image Quality | Service Life (number of runs) | Storage Stability |
| 2 | Copolymer B 90 | 10 | Good | Good | Good | Good | More than 20,000 | Good |
| 3 | Copolymer C 90 | 10 | Good | Good | Good | Good | More than 20,000 | Good |
| 4 | Copolymer D 90 | 10 | Good | Good | Good | Good | More than 20,000 | Good |
| 5 | Copolymer E 90 | 10 | Good | Good | Good | Good | More than 20,000 | Good |
| 6 | Copolymer F 90 | 10 | Good | Good | Good | Good | More than 20,000 | Good |
| 7 | Copolymer A 50<br>Polystyrene | 10 | Good | Good | Good | Good | More than 20,000 | Good |
| 8 | Copolymer D 50<br>Maleinized rosin 40 | 10 | Good | Good | Good | Good | More than 20,000 | Good |

EXAMPLE 9

According to the procedure of Examples 1–8, a toner was prepared from 5 parts by weight of cinnamic acid, 85 parts by weight of the same polystyrene as used in Example 7, and 10 parts by weight of carbon black. Then, the resulting toner was subjected to evaluation tests in the same manner as described in Examples 1–8. The results thus obtained are summarized in Table 3.

EXAMPLE 10

According to the procedure of Examples 1–8, a toner was prepared from 16 parts by weight of cinnamic acid, 74 parts by weight of the same polystyrene as used in Example 7, and 10 parts by weight of carbon black. Then, the resulting toner was subjected to evaluation tests in the same manner as described in Examples 1–8. The results thus obtained are summarized in Table 3.

EXAMPLE 11

According to the procedure of Examples 1–8, a toner was prepared from 24 parts by weight of cinnamic acid, 66 parts by weight of the same maleinized rosin as used in Example 8, and 10 parts by weight of carbon black. Then, the resulting toner was subjected to evaluation tests in the same manner as described in Examples 1–8. The results thus obtained are summarized in Table 3.

EXAMPLE 12

According to the procedure of Examples 1–8, a toner was prepared from 1 part by weight of cinnamic acid, 89 parts by weight of the same maleinized rosin as used in Example 8, and 10 parts by weight of carbon black. Then, the resulting toner was subjected to evaluation tests in the same manner as described in Examples 1–8. The results thus obtained are summarized in Table 3.

EXAMPLE 13

According to the procedure of Examples 1–8, a toner was prepared from 85 parts by weight of the same resin (copolymer B) as used in Example 2, 5 parts by weight of cinnamic acid, and 10 parts by weight of carbon black. Then, the resulting toner was subjected to evaluation tests in the same manner as described in Examples 1–8. The results thus obtained are summarized in Table 3.

EXAMPLE 14

According to the procedure of Examples 1–8, a toner was prepared from 89.5 parts by weight of the same resin (copolymer E) as used in Example 5, 0.5 part by weight of cinnamic acid, and 10 parts by weight of carbon black. Then, the resulting toner was subjected to evaluation tests in the same manner as described in Examples 1–8. The results thus obtained are summarized in Table 3.

EXAMPLE 15

According to the procedure of Examples 1–8, a toner was prepared from 50 parts by weight of the same resin (copolymer C) as used in Example 3, 30 parts by weight of the same polystyrene as used in Example 7, 10 parts by weight of cinnamic acid, and 10 parts by weight of carbon black. Then, the resulting toner was subjected to evaluation tests in the same manner as described in Examples 1–8. The results thus obtained are summarized in Table 3.

EXAMPLE 16

According to the procedure of Examples 1–8, a toner was prepared from 30 parts by weight of the same resin (copolymer F) as used in Example 6, 59 parts by weight of the same maleinized rosin as used in Example 8, 1 part by weight of cinnamic acid, and 10 parts by weight of carbon black. Then, the resulting toner was subjected to evaluation tests in the same manner as described in Examples 1–8. The results thus obtained are summarized in Table 3.

COMPARATIVE EXAMPLE 1

According to the procedure of Examples 1–8, a toner containing no cinnamic acid was prepared from 90 parts by weight of the same polystyrene as used in Example 7 and 10 parts by weight of carbon black. Then, the resulting toner was subjected to evaluation tests in the same manner as described in Examples 1–8. The results thus obtained are summarized in Table 3.

COMPARATIVE EXAMPLE 2

According to the procedure of Examples 1–8, a toner containing no cinnamic acid was prepared from 90 parts by weight of the same maleinized rosin as used in Example 8 and 10 parts by weight of carbon black. Then, the resulting toner was subjected to evaluation tests in the same manner as described in Examples 1–8. The results thus obtained are summarized in Table 3.

TABLE 3

| | | Formulation | | | Toner Performance | | | | | |
|---|---|---|---|---|---|---|---|---|---|---|
| | | Constituent Resin (parts by Weight) | | Carbon Black (parts by weight) | Triboelectric Charging Properties | Transfer Properties | Fixing Properties | Image Quality | Service Life (number of runs) | Storage Stability |
| Example | 9 | Cinnamic acid<br>Polystyrene | 5<br>85 | 10 | Good | Good | Good | Good | More than 20,000 | Good |
| | 10 | Cinnamic acid<br>Polystyrene | 16<br>74 | 10 | Good | Good | Good | Good | More than 20,000 | Good |
| | 11 | Cinnamic Acid<br>Maleinized rosin | 24<br>66 | 10 | Good | Good | Good | Good | More than 20,000 | Good |
| | 12 | Cinnamic acid<br>Maleinized rosin | 1<br>89 | 10 | Good | Good | Good | Good | More than 20,000 | Good |
| | 13 | Copolymer B<br>Cinnamic acid | 85<br>5 | 10 | Good | Good | Good | Good | More than 20,000 | Good |
| | 14 | Copolymer E<br>Cinnamic acid | 89.5<br>0.5 | 10 | Good | Good | Good | Good | More than 20,000 | Good |
| | 15 | Copolymer C<br>Polystyrene<br>Cinnamic acid | 50<br>30<br>10 | 10 | Good | Good | Good | Good | More than 20,000 | Good |
| | 16 | Copolymer F<br>Maleinized rosin<br>Cinnamic acid | 30<br>59<br>1 | 10 | Good | Good | Good | Good | More than 20,000 | Good |
| Comparative Example | 1 | Polystyrene | 90 | 10 | Rather poor | Rather good | Rather good | Poor | Less than 1,000 | Good |
| | 2 | Maleinized rosin | 90 | 10 | Rather poor | Rather good | Rather good | Poor | Less than 1,000 | Rather good |

What is claimed is:

1. A toner composition for use in the development of electrostatic latent images comprising a constituent resin and a carbon black colorant, said constituent resin containing a member selected from the group consisting of:

(a) a copolymer of cinnamic acid with a vinyl monomer selected from the group consisting of styrene, a styrene derivative, an ethylenically unsaturated carboxylic acid, an acrylic ester, a methacrylic ester, an itaconic ester, a fumaric ester, an organic amide, an ethylenic monoolefin, a vinyl ester of a lower aliphatic monocarboxylic acid and a mixture of two or more of said vinyl monomers;

(b) a mixture of uncombined cinnamic acid with a copolymer as defined in (a);

(c) a mixture of uncombined cinnamic acid with a polymer selected from the group consisting of styrene-resin, acrylic resin, styrene-acrylate copolymer resin, styrene-butadiene copolymer resin, epoxy resin, polyurethane resin, polyether resin, coumarone resin, maleinized rosin, rosin-modified phenolformaldehyde resin, cellulose resin, polyamide resin, silicone resin, polyvinyl butyral resin, phenolic resin and a mixture of two or more of said polymers;

(d) a mixture of a copolymer as defined in (a) with a polymer as defined in (c); and (e) a mixture of uncombined cinnamic acid with a mixture as defined in (d), said constituent resin having a softening point of from room temperature to 170° C., and the cinnamic acid content of the constituent resin being from 1 to 25 parts by weight per 100 parts by weight of the constituent resin in the cases of cinnamic acid copolymerized with one or more vinyl monomers and from 0.1 to 25 parts by weight per 100 parts by weight of the constituent resin in the case of cinnamic acid present in the uncombined state.

2. A toner composition as claimed in claim 1 wherein the sum of the content of cinnamic acid copolymerized with one or more vinyl monomers and the content of cinnamic acid present in the uncombined state does not exceed 25 parts by weight per 100 parts by weight of the constituent resin.

3. A toner composition as claimed in claim 1 wherein the content of cinnamic acid copolymerized with one or more vinyl monomers is from 1 to 15 parts by weight per 100 parts by weight of the constituent resin and the content of cinnamic acid present in the uncombined state is from 1 to 15 parts by weight per 100 parts by weight of the constituent resin.

4. A toner composition as claimed in claim 1 wherein the polymer is a member selected from the group consisting of styrene resin, acrylic resin, styrene-acrylate copolymer resin, styrene-butadiene copolymer resin, epoxy resin, maleinized rosin and a mixture of two or more of said members.

5. A toner composition as claimed in claim 1 wherein the constituent resin has a softening point ranging from 50° to 150° C.

6. A toner composition as claimed in claim 1 wherein the constituent resin additionally contains a member selected from the group consisting of a low-molecular-weight polyalkylene compound, a paraffin wax, a fatty acid metal salt, a fatty acid amide, a liquid acrylic resin, a plasticizer, a pigment dispersing agent and a mixture of two or more of said members.

7. A toner composition as claimed in claim 1, which is prepared by preblending said constituent resin with said colorant, melting the preblended mixture, and forming the melted mixture into a powder, said colorant thereby being dispersed in said constituent resin.

8. A toner composition as claimed in claim 1, which is prepared by dissolving said constituent resin and said colorant in a solvent, and spraying the resulting solution as an atomized mist to dry it, said colorant thereby being dispersed in said constituent resin.

9. A toner composition for use in the development of electrostatic latent images comprising a constituent resin and a carbon black colorant, said constituent resin containing a member selected from the group consisting of:

(a) a copolymer of cinnamic acid and a compound selected from the group consisting of styrene, a styrene derivative, acrylic acid, methacrylic acid, an acrylic ester, a methacrylic ester, acrylamide, vinyl acetate, dibutyl fumarate and a mixture of two or more of said compounds;

(b) a mixture of uncombined cinnamic acid with a copolymer as defined in (a);

(c) a mixture of uncombined cinnamic acid with a polymer selected from the group consisting of styrene resin, acrylic resin, styrene-acrylate copolymer resin, styrene-butadiene copolymer resin, epoxy resin, polyurethane resin, polyether resin coumarone resin, maleinized rosin, rosin-modified phenol-formaldehyde resin, cellulose resin, polyamide resin, silicone resin, polyvinyl butyral resin, phenolic resin and a mixture of two or more of said polymers;

(d) a mixture of copolymer as defined in (a) with a polymer as defined in (c); and (e) a mixture of uncombined cinnamic acid with a mixture as defined in (d), said constituent resin having a softening point of from room temperature to 170° C., the cinnamic acid content of the constituent resin being from 1 to 25 parts by weight per 100 parts by weight of the constituent resin in the case of cinnamic acid copolymerized with one or more vinyl monomers and from 0.1 to 25 parts by weight per 100 parts by weight of the constituent resin in the case of cinnamic acid present in the uncombined state.

10. A toner composition as claimed in claim 9 wherein said polymer is a member selected from the group consisting of styrene resin, acrylic resin, styrene-acrylate copolymer resin, styrene-butadiene copolymer resin, epoxy resin, maleinized rosin and a mixture of two or more of said members.

11. A toner composition as claimed in claim 9 wherein the constituent resin has a softening point of from 50° to 150° C.

12. A toner composition as claimed in claim 9 wherein the constituent resin additionally contains a member selected from the group consisting of a low-molecular weight polyalkylene compound, a paraffin wax, a fatty acid metal salt, a fatty acid amide, a liquid acrylic resin, a plasticizer, a pigment dispersing agent and a mixture of two or more of said members.

13. A toner composition as claimed in claim 9 wherein said styrene derivative is selected from α-methylstyrene, p-chlorostyrene and vinyltoluene.

14. A toner composition as claimed in claim 9 wherein said acrylic ester is selected from methyl acrylate, ethyl acrylate, isobutyl acrylate, n-butyl acrylate, 2-ethylhexyl acrylate, dodecyl acrylate, cyclohexyl acrylate, 2-chloroethyl acrylate, 2-hydroxylethyl acrylate, dimethylaminoethyl acrylate and methyl α-chloroacrylate.

15. A toner composition as claimed in claim 9 wherein said methacrylic ester is selected from methyl methacrylate, ethyl methacrylate, propyl methacrylate, isobutyl methacrylate, n-butyl methacrylate, 2-ethylhexyl methacrylate, lauryl methacrylate, stearyl methacrylate, phenyl methacrylate, cyclohexyl methacrylate, tridecyl methacrylate, 2-hydroxyethyl methacrylate, 2-hydroxypropyl methacrylate, dimethylaminoethyl methacrylate and diethylaminoethyl methacrylate.

16. A toner composition as claimed in claim 13 wherein said copolymer is a member selected from the group consisting of a cinnamic acid/styrene/2-ethylhexyl acrylate copolymer, a cinnamic acid/styrene/n-butyl methacrylate copolymer and a cinnamic acid/styrene/methyl methacrylate/n-butyl acrylate copolymer.

17. A toner composition for use in the development of electrostatic latent images comprising a constituent resin which contains a copolymer of cinnamic acid, styrene and a member selected from the group consisting of α-methylstyrene, n-butyl acrylate, 2-ethylhexyl acrylate, 2-hydroxyethyl acrylate, methyl methacrylate, n-butyl methacrylate, diethylaminoethyl methacrylate, acrylamide, methacrylic acid, vinyl acetate, dibutyl fumarate and a mixture of two or more of said members, said constituent resin having a softening point of from 50° to 150° C., and the cinnamic acid content of said constituent resin being from 1 to 25 parts by weight per 100 parts by weight of said constituent resin.

18. A toner composition as claimed in claim 17 wherein said constituent resin further contains styrene-acrylate copolymer resin or styrene-butadiene copolymer resin.

19. A toner composition for use in the development of electrostatic latent images consisting of a constituent resin, a carbon black colorant dispersed in said constituent resin and optionally a member selected from the group consisting of a low-molecular weight polyalkylene compound, a paraffin wax, a fatty acid metal salt, a fatty acid amide, a liquid acrylic resin, a plasticizer, a pigment dispersing agent and a mixture of two or more of said members, said constituent resin containing said member, and said constituent resin containing a member selected from the group consisting of:

(a) a copolymer of cinnamic acid with a vinyl monomer selected from the group consisting of styrene, a styrene derivative, an ethylenically unsaturated carboxylic acid, an acrylic ester, a methacrylic ester, an itaconic ester, a fumaric ester, an organic amide, an ethylenic monoolefin, a vinyl ester of a lower aliphatic monocarboxylic acid and a mixture of two or more of said vinyl monomers;

(b) a mixture of uncombined cinnamic acid with a copolymer as defined in (a);

(c) a mixture of uncombined cinnamic acid with a polymer selected from the group consisting of styrene-resin, acrylic resin, styrene-acrylate copolymer resin, styrene-butadiene copolymer resin, epoxy resin, polyurethane resin, polyether resin, coumarone resin, maleinized rosin, rosin-modified phenol-formaldehyde resin, cellulose resin, polyamide resin, silicone resin, polyvinyl butyral resin, phenolic resin and a mixture of two or more of said polymers;

(d) a mixture of a copolymer as defined in (a) with a polymer as defined in (c); and (e) a mixture of uncombined cinnamic acid with a mixture as defined in (d); said constituent resin having a softening point of from room temperature to 170° C., and the cinnamic acid content of the constituent resin being from 1 to 25 parts by weight per 100 parts by weight of the constituent resin in the case of cinnamic acid copolymerized with one or more vinyl monomers and from 0.1 to 25 parts by weight per 100 parts by weight of the constituent resin in the case of cinnamic acid present in the uncombined state.

20. A toner composition for use in the development of electrostatic latent images comprising a constituent resin and a carbon black colorant dispersed in said constituent resin, said constituent resin containing a member selected from the group consisting of:

(a) a copolymer of cinnamic acid with a vinyl monomer selected from the group consisting of styrene, a styrene derivative, an ethylenically unsaturated carboxylic acid, an acrylic ester, a methacrylic ester, an itaconic ester, a fumaric ester, an organic amide, an ethylenic monoolefin, a vinyl ester of a lower aliphatic monocarboxylic acid and a mixture of two or more of said vinyl monomers;

(b) a mixture of uncombined cinnamic acid with a copolymer as defined in (a);

(c) a mixture of uncombined cinnamic acid with a polymer selected from the group consisting of styrene-resin, acrylic resin, styrene-acrylate copolymer resin, styrene-butadiene copolymer resin, epoxy resin, polyurethane resin, polyether resin, coumarone resin, maleinized rosin-modified phenolformaldehyde resin, cellulose resin, polyamide resin, silicone resin, polyvinyl butyral resin, phenolic resin and a mixture of two or more of said polymers;

(d) a mixture of a copolymer as defined in (a) with a polymer as defined in (c); and (e) a mixture of uncombined cinnamic acid with a mixture as defined in (d), said constituent resin having a softening point of from room temperature to 170° C., and the cinnamic acid content of the constituent resin being from 1 to 25 parts by weight per 100 parts by weight of the constituent resin in the case of cinnamic acid copolymerized with one or more vinyl monomers and from 0.1 to 25 parts by weight per 100 parts by weight of the constituent resin in the case of cinnamic acid present in the uncombined state.

* * * * *